US005392540A

United States Patent [19]

Cooper et al.

[11] Patent Number: 5,392,540

[45] Date of Patent: Feb. 28, 1995

[54] MOUNTING APPARATUS FOR A BRIDGE OF A TRENCHING MACHINE

[75] Inventors: Mark Cooper; Keith Roozeboom, both of Pella, Iowa

[73] Assignee: Vermeer Manufacturing Company, Pella, Iowa

[21] Appl. No.: 75,169

[22] Filed: Jun. 10, 1993

[51] Int. Cl.[6] ..... E02F 5/02

[52] U.S. Cl. ..... 37/349; 37/355; 405/180

[58] Field of Search ..... 37/362, 349, 352, 355, 37/353, 359; 414/745.4; 198/518, 522, 519; 299/80, 64; 405/181, 180, 174; 403/3, 4

[56] References Cited

U.S. PATENT DOCUMENTS

| | | | |
|---|---|---|---|
| 2,584,287 | 2/1952 | Przybylski | 37/349 |
| 2,649,792 | 8/1953 | Miller | 37/349 |
| 3,570,152 | 3/1971 | Schuermann et al. | 37/349 |
| 3,618,676 | 11/1971 | Penste | 37/349 |
| 4,483,084 | 11/1984 | Caldwell et al. | 37/362 |
| 4,742,627 | 5/1988 | Lindstrom | 37/349 |
| 5,033,214 | 7/1991 | Kaczmarski et al. | 37/362 |
| 5,113,609 | 5/1992 | Camilleri | 37/362 |

*Primary Examiner*—Randolph A. Reese
*Assistant Examiner*—Spencer Warnick
*Attorney, Agent, or Firm*—Kent A. Herink; Brian J. Laurenzo; Brett J. Trout

[57] ABSTRACT

A trenching bridge mounting interface for a trenching machine that is adjustable to alter the effective length of a fixed length bridge so as to accommodate trenching bars of different lengths. The interface includes a prime mover mounting structure that is releasably secured to the prime mover of the trenching machine and a bridge mounting structure attached to the fixed length bridge. The effective length of the bridge is adjusted between a short length and a long length by reversing of the prime mover mounting structure.

12 Claims, 5 Drawing Sheets

MOUNTING APPARATUS FOR A BRIDGE OF A TRENCHING MACHINE

BACKGROUND OF THE INVENTION

The invention relates to a mounting apparatus for a bridge of a trenching machine and, more particularly, to a bridge mounting interface that is reversible to extend the effective length of a fixed length trenching boom bridge.

Trenching machines commonly employ a rearwardly extended trenching boom that carries an endless trenching chain. The trenching boom is attached to a prime mover that also provides the power for moving the endless trenching chain. It is common to use a trenching boom bridge, including a crumber attachment mounted at its distal end portion, to assist in the removal of spoil created by the endless chain from the trench.

Trenching booms of adjustable length are known in the art whereby sections may be added to or taken from a trenching boom and the endless trenching chain lengthened or shortened accordingly. Heretofore, it has been necessary to change the length of the trenching bridge in order to accommodate the adjusted length of the trenching boom so as to maintain the appropriate working position of the crumber attachment. One approach used in the prior art is to make the trenching bridge out of nesting subelements so that it is adjustable in length by telescopic action. Such a telescoping trenching bridge is described in U.S. Pat. No. 5,033,214.

The present invention provides a bridge mounting apparatus which is reversible to permit the use of a fixed length bridge on trenching booms of different lengths.

Summary of the Invention

The invention consists of a mounting apparatus for a bridge of a trenching machine that includes a prime mover to which is mounted a trenching boom. The mounting apparatus includes a bridge mounting member that has a pair of transversely spaced attachment surfaces of a substantially inverted V-shape in cross section. Also included is a mounting member for releasable attachment to the prime mover. The mounting member consists of two unitary elements that are mirror images of each other. Each unitary element includes an inwardly projected ear having a section of a substantially inverted V-shape in cross section. The attachment surfaces of the bridge mounting member are placed in contact with the inwardly projected ears and releasably attached thereto by a plurality of bolts. The mounting member is reversible to adjust the position of the inwardly projected ears longitudinally relative to the prime mover. Accordingly, reversing of the mounting member will change the effective length of the fixed length bridge.

A purpose of the present invention is to provide a mounting apparatus for a fixed length trenching bridge of a trenching machine adjustable to accommodate trenching booms of different lengths.

This and other purposes of the invention will be made apparent upon a review and understanding of the specification, drawings, and appended claims.

DETAILED DESCRIPTION OF A PREFERRED EMBODIMENT

Figure 1:
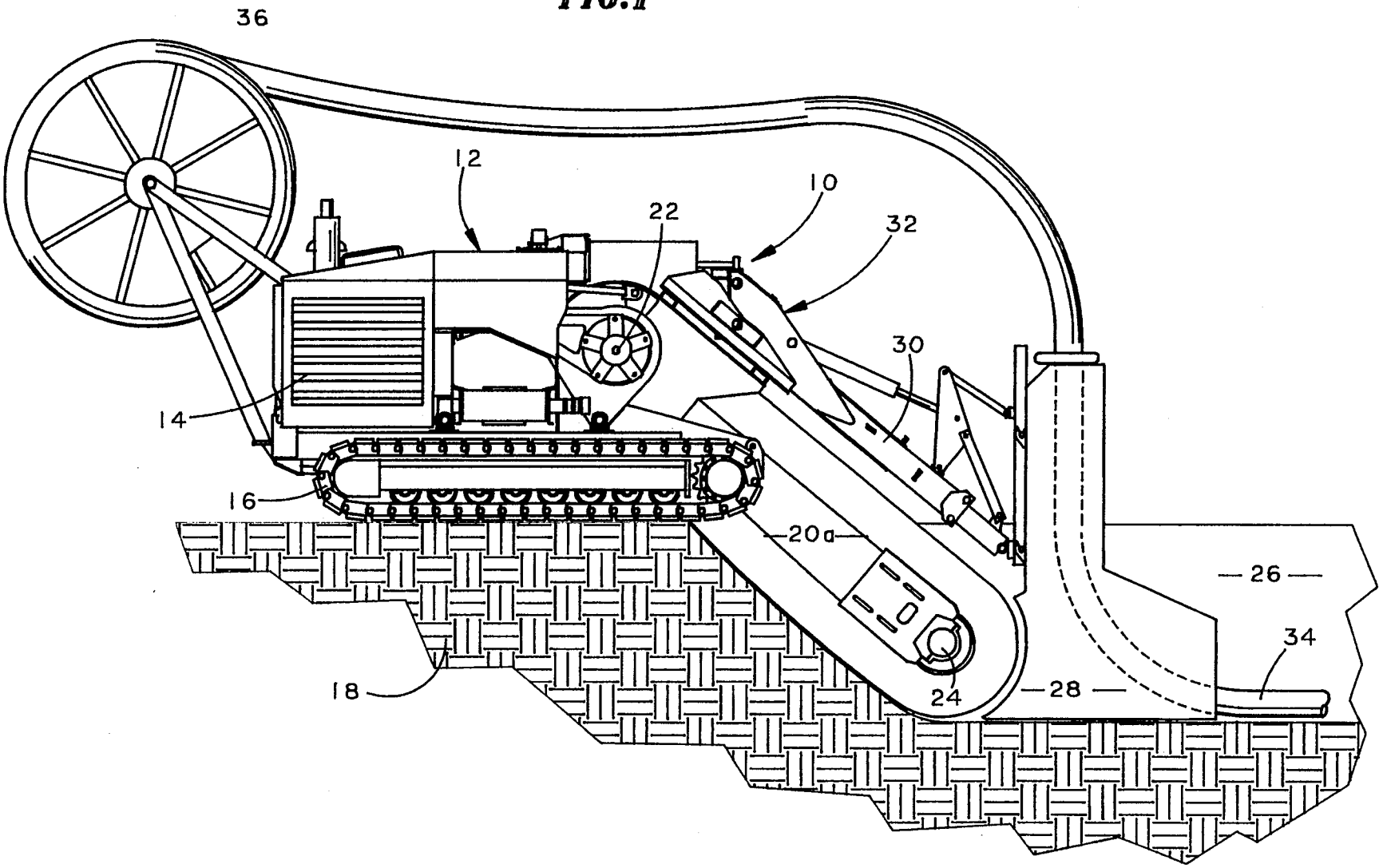
FIG. 1 is a side view of a ground-supported trenching machine having a trenching boom of a first, short length.

,Illustrated in FIG. 1, generally at 10, is track trenching machine, including a prime mover 12 consisting principally of an engine 14 and endless tracks 16 for transporting the trenching machine 10 across the ground 18. The trenching machine 10 also includes a trenching boom 20*a* of a first, short length. The trenching boom 20*a* includes the usual endless trenching chain (not shown) which is trained about an upper drive sprocket 22 and a lower idler wheel 24. The drive sprocket 22 is driven by the engine 14 in the clockwise direction of FIG. 1. The action of the trenching chain and forward motion of the trenching machine 10 creates a ground trench 26.

The trenching machine 10 includes a combination crumber and tile box 28 that is positioned at the bottom of the trench 26 closely adjacent to the trenching boom 20*a*. The crumber and tile box 28 assist in the removal by the endless trenching chain of spoil from the trench 26. The combination crumber and tile box 28 is held in position by a fixed length trenching bridge 30 that is attached to the prime mover 12 by a mounting apparatus 32 of the present invention. The combination crumber and tile box 28 also aids in the positioning of a length of tile 34 at the bottom of the trench 26, unrolling it off of a supply reel 36 at the front of the trenching machine 10.

Figure 2:
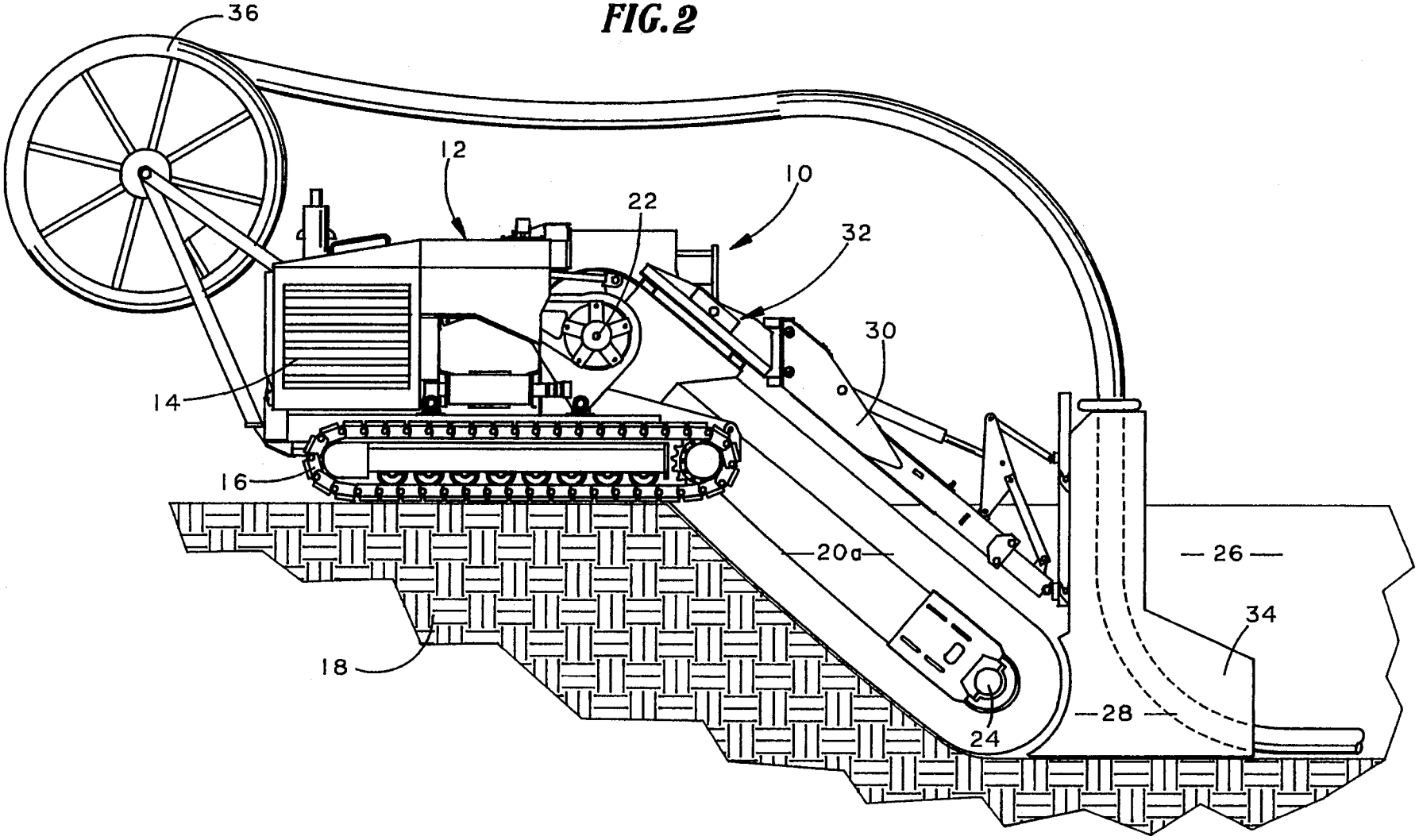
FIG. 2 is a side view of the trenching machine of FIG. 1 wherein the trenching boom has been extended to a second, longer length.

The trenching machine 10 is also illustrated in FIG. 2 wherein the trenching boom 20*b* is of a second, long or extended length. As will be described in more detail below, the mounting apparatus 32 has been adjusted to extend the effective length of the fixed length trenching bridge 30 so as to maintain the appropriate spacing and relationship of the combination crumber and the box 28 relative to the extended length trenching boom 20*b*.

Figure 6:
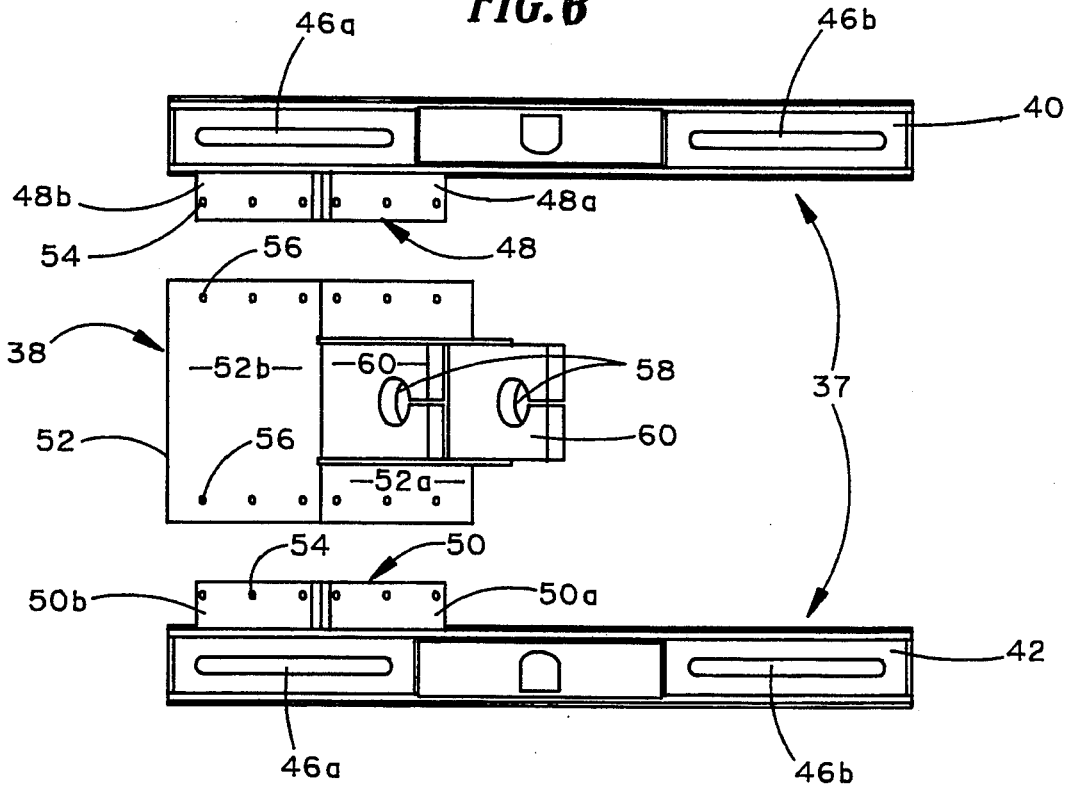
FIG. 6 is a top view of the mounting apparatus corresponding to the first, short length position.
Figure 7:
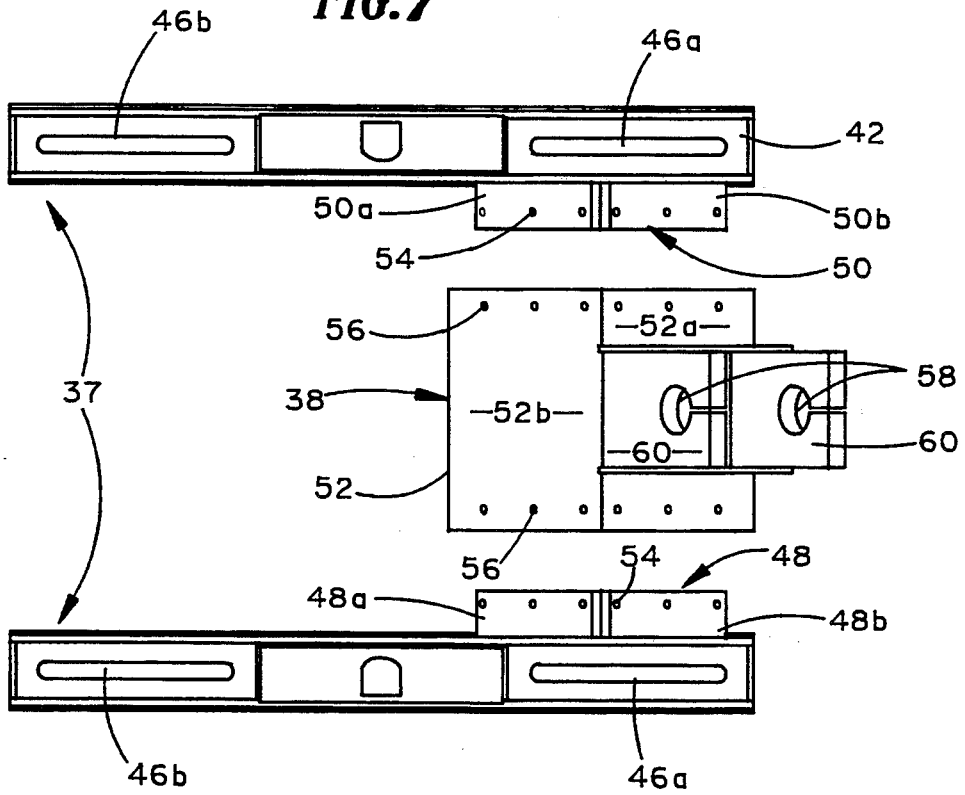
FIG. 7 is a top view of the mounting apparatus corresponding to the second, long length position.

The mounting apparatus 32, as best illustrated in FIGS. 3–7, consists of two principal members, a prime mover mounting member, indicated generally at 37 and a bridge mounting member 38 (FIGS. 6 and 7). The prime mover mounting member 37 in the preferred embodiment comprises two unitary elements, first unitary element 40 and second unitary element 42 which are mirror images of each other. Each of the unitary elements 40 and 42 are releasably attachable to the prime mover 12 (FIG. 5) by a pair of nut and bolt combinations 44*a* and 44*b* through a corresponding one of the elongated slots 46*a* and 46*b*. The unitary elements 40 and 42 are mounted equidistantly on either side of the trenching boom.

Figures 3, 4, 5:
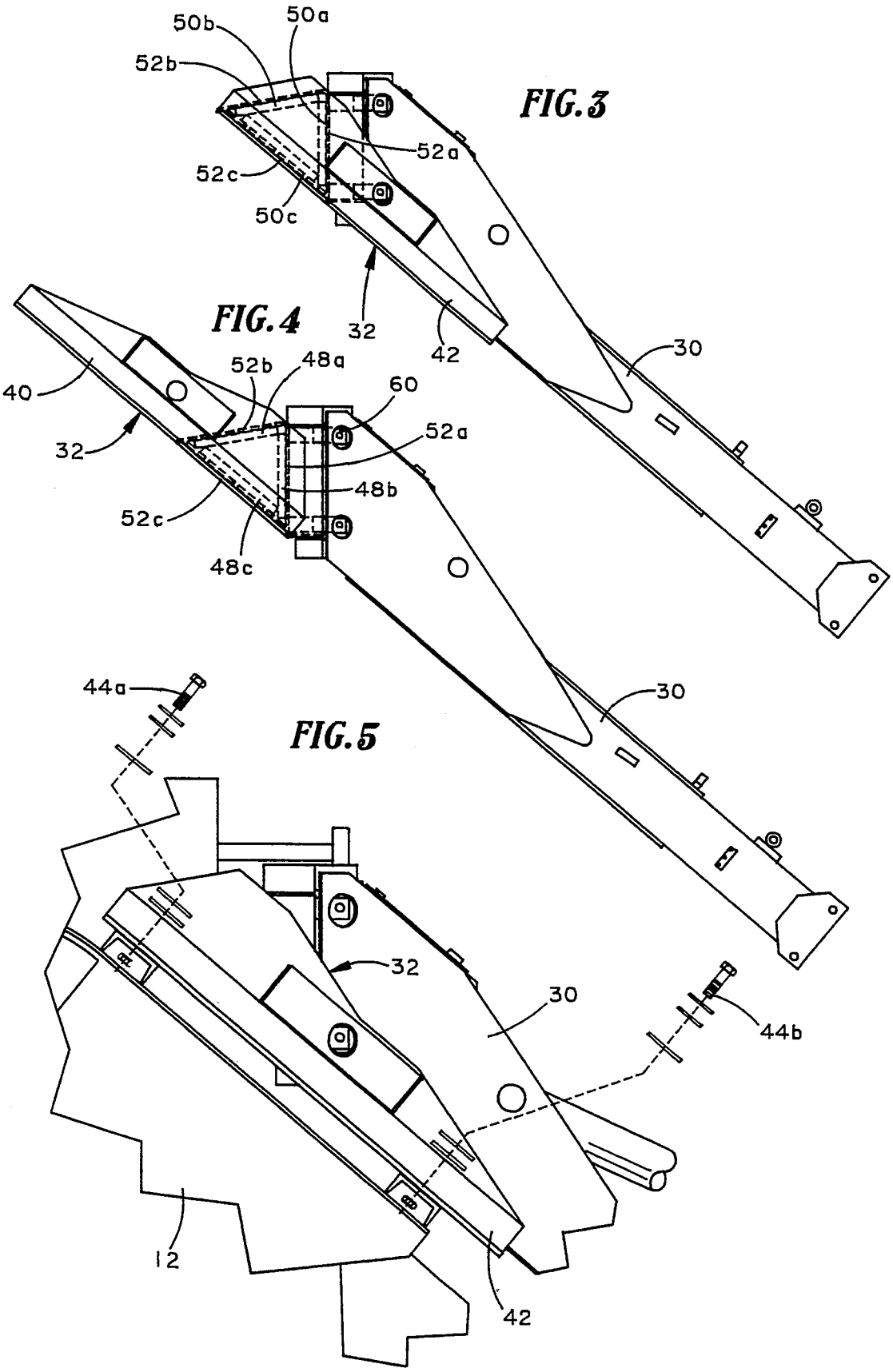
FIG. 3 is a side view of the bridge mounting apparatus in the position corresponding to FIG. 1.
FIG. 4 is a side view of the bridge mounting apparatus and the position corresponding to FIG. 2.
FIG. 5 is an enlarged detail view corresponding to FIG. 3 particularly illustrating the attachment of the mounting member to the prime mover.
Figure 9:
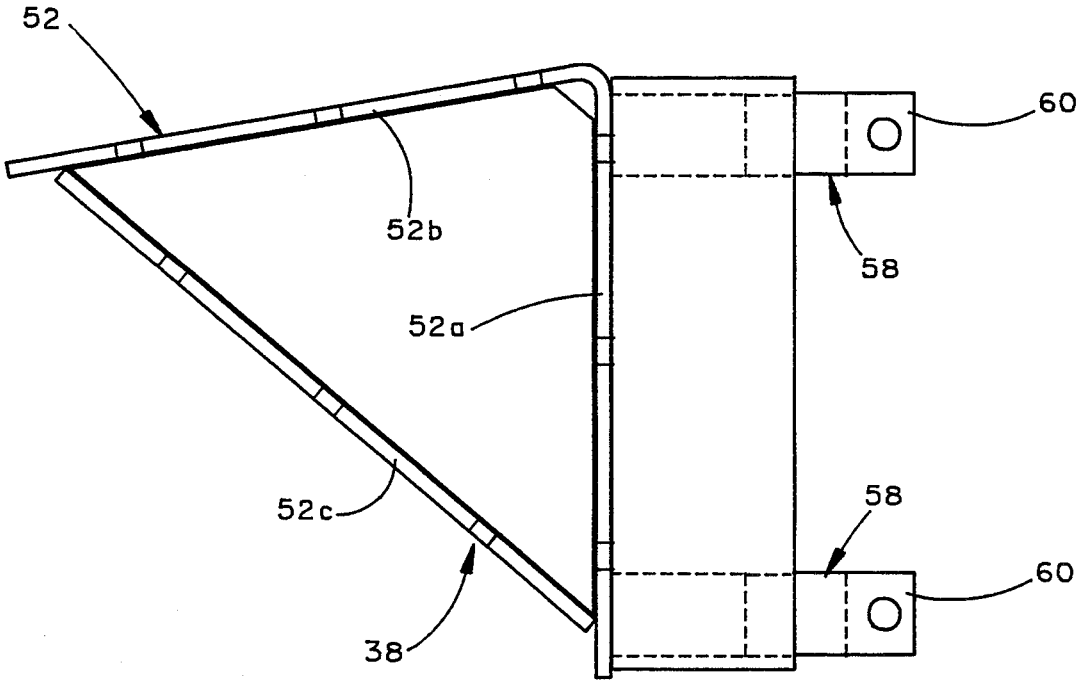
FIG. 9 is an enlarged side view of a bridge mounting member of the present invention.

Each unitary element 40 and 42 includes an inwardly projected ear 48 and 50, respectively. The ears 48 and 50 are of a substantially triangular shape in cross section each of which has two upwardly facing sides 48*a* and b and 50*a* and *b*, respectively, of a substantially inverted V-shape in cross section and a bottom side 48*c* and 50*c*. The ears 48 and 50 are positioned near the end portion of the corresponding unitary element 40 and 42 that is adjacent the elongated slot 46*a* (FIGS. 3 and 4, 6 and 7). The bridge mounting member 38 includes a mounting bracket 52 (FIG. 9) that is of a substantially triangular shape in cross section so as to be in full support contact with the ears 48 and 50 in assembled relation with the prime mover mounting member (FIGS. 3 and 4). Accordingly, the bracket 52 includes two upwardly facing sides 52*a* and 52*b* of a substantially inverted V-shape in cross section, and a bottom side 52*c*. In the preferred embodiment, the sides 52*a* and 52*b* are formed of a single bent sheet and the bottom side 52*c* of a separate sheet or plate. A plurality of openings 54 in the sides 48*a–c* and 50*a–c* of the ears 48 and 50 align with corresponding openings 56 in the corresponding sides 52*a–c* of mounting bracket 52 (FIGS. 6 and 7) and receive bolts (not shown) for releasably securing the bridge mounting member 38 to the prime mover mounting member 37.

The bridge 30 is mounted to the bridge mounting member 38 for pivotal movement about a vertical axis by a pin that is received in aligned openings 58 of a pair of spaced apart support members 60 that are secured to the side 52*a* of the mounting bracket 52.

When the unitary members 40 and 42 are attached to the prime mover 12 in the orientation depicted in FIGS. 3, 5 and 6, the trenching bridge 30 extends from the prime mover 12 a fixed, short length (FIG. 1). In this position, the bridge 30 supports the crumber 28 in the appropriate position for the short trenching boom 20*a*. The effective length of the bridge 30 is extended by removing the nut and bolt combinations 44 to release the prime mover mounting member 37 from the prime mover 12. Then the mounting bracket 52 of the bridge mounting member 38 is unbolted from the ears 48 and 50. The pair of unitary members 40 and 42 are then reversed by pivoting each 180° and switching positions (FIG. 7). Reassembly results in a shift in position of the ears 48 and 50 and the attached bridge mounting member 38 as illustrated by comparing FIGS. 3 and 4 and FIGS. 6 and 7. The result is an extension of the position of the crumber 28 from that illustrated in FIG. 1 to that illustrated in FIG. 2.

In the preferred embodiment, reversing of the unitary members 40 and 42, without further adjustment, extends the effective length by approximately two feet. Accordingly, if the trenching boom 20*a* is six feet long, the longer trenching boom 20*b* may be eight feet in length. Additional length adjustments can be made by sliding of the unitary members 40 and 42 in either orientation relative to the prime mover 12 by virtue of the elongated slots 46.

Figure 8:
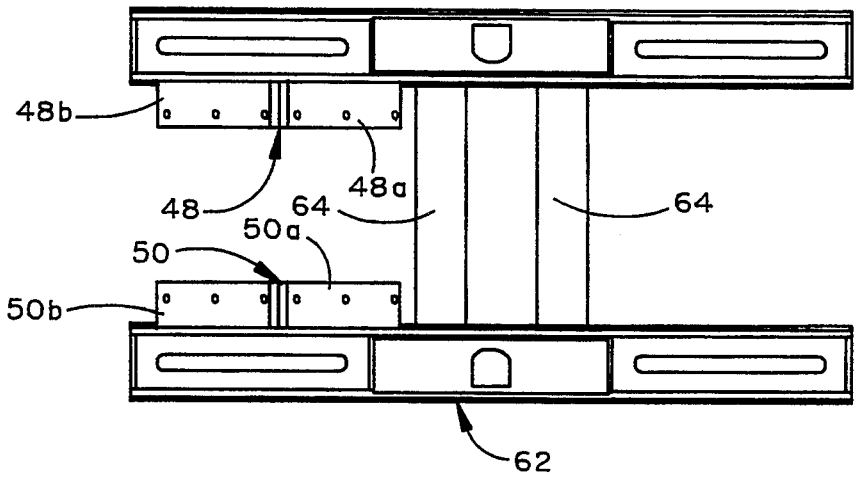
FIG. 8 is a top view of a second embodiment of a prime mover mounting member of the present invention.

Although in the preferred embodiment, the prime mover mounting member is comprised of two unitary elements, it can alternatively be made into a unit 62, as illustrated in FIG. 8, by the addition of one or more transverse web members 64. In the alternative embodiment, the bracket 52 has only the two upwardly facing sides 52*a* and 52*b* and is placed atop the two upwardly facing sides 48*a* and 48*b*, and 50*a* and 50*b*, of the ears 48 and 50, respectively. With this exception, the assembly and function of the mounting apparatus is identical whether the prime mover mounting member is a single unit or includes two separate unitary members.

Although the invention has been described with respect to a preferred embodiment thereof, it is to be also understood that it is not to be so limited since changes and modifications can be made therein which are within the full intended scope of this invention as defined by the appended claims.

I claim:

1. Mounting apparatus for a bridge of a trenching machine including a prime mover, comprising:
   (a) means for attachment to the bridge;
   (b) means for releasable attachment to the prime mover and movable between a first position and a second, reversed position; and
   (c) means for releasably securing said bridge attachment means to said prime mover attachment means such that the bridge extends from the prime mover a first distance when said prime mover attachment means is in said first position and a second distance when said prime mover attachment means is in said second position.

2. Mounting apparatus as defined in claim 1, wherein said prime mover attachment means is a single-piece element.

3. Mounting apparatus as defined in claim 1, wherein said prime mover attachment means includes a first unitary element and a second unitary element.

4. Mounting apparatus as defined in claim 3 wherein, said second unitary element is a mirror image of said first unitary element.

5. Mounting apparatus as defined in claim 3, wherein the trenching machine includes a trenching boom and wherein said first and second unitary elements are mounted equidistantly on either side of the trenching boom.

6. Mounting apparatus as defined in claim 3, wherein said prime mover attachment means is movable between said first position and said second, reversed position by exchanging the positions of said first and second unitary elements while also changing end for end the orientation of each of said unitary elements.

7. Mounting apparatus as defined in claim 5, wherein said releasable securing means comprises an inwardly projecting mounting ear on each of said unitary elements.

8. Mounting apparatus as defined in claim 7, wherein said bridge attachment means comprises a pair of attachment surfaces for mating contact with said mounting ears.

9. Mounting apparatus as defined in claim 7, wherein said mounting ears include a portion which is substantially of an inverted V-shape in cross section.

10. Mounting apparatus as defined in claim 9, wherein said bridge attachment means comprises a pair of attachment surfaces of substantially an inverted V-shape in cross section for mating contact with said mounting ears.

11. An extensible bridge for a trenching machine which includes a prime mover, comprising:
   (a) means for releasable attachment to the prime mover and movable between a first position and a second, reversed position;
   (b) a fixed length bridge member;
   (c) means for attachment to said bridge member; and (d) means for releasably securing said bridge member attachment means to said prime mover attachment means such that said fixed length bridge member extends farther from said prime mover when said prime mover attachment means is in said first position than when in said second, reversed position.

12. Mounting apparatus for a bridge of a trenching machine which includes a prime mover and a trenching boom mounted on the prime mover, the mounting apparatus comprising:

(a) a bridge mounting member including a pair of transversely spaced attachment surfaces of a substantially inverted V-shape in cross section;

(b) a first unitary element for releasable attachment to said prime mover;

(c) a second unitary element for releasable attachment to said prime mover, and which is a mirror image of said first unitary element;

(d) an inwardly projecting ear on each of said unitary elements, each of which includes a portion which is of a substantially inverted V-shape in cross section for mating contact with said attachment surfaces of said bridge mounting member; and (e) means for releasably securing each of said attachment surfaces of said bridge mounting member to a corresponding one of said inwardly projecting ears of said first and second unitary members.

* * * * *